US010039695B1

(12) United States Patent
Egan-Wyer et al.

(10) Patent No.: US 10,039,695 B1
(45) Date of Patent: Aug. 7, 2018

(54) DECORATIVE ATTACHMENT FOR A BABY BOTTLE

(71) Applicants: Damien O. Egan-Wyer, Oshawa (CA); Jennifer Long, Oshawa (CA)

(72) Inventors: Damien O. Egan-Wyer, Oshawa (CA); Jennifer Long, Oshawa (CA)

( * ) Notice: Subject to any disclaimer, the term of this patent is extended or adjusted under 35 U.S.C. 154(b) by 5 days.

(21) Appl. No.: 15/209,024

(22) Filed: Jul. 13, 2016

(51) Int. Cl.
*B65D 23/12* (2006.01)
*A61J 17/00* (2006.01)
*A61J 9/06* (2006.01)

(52) U.S. Cl.
CPC ..... *A61J 17/001* (2015.05); *A61J 9/0607* (2015.05)

(58) Field of Classification Search
CPC ..... A61J 9/0607; A61J 17/001; A61J 9/00; A61J 7/04
USPC ..... 215/386
See application file for complete search history.

(56) References Cited

U.S. PATENT DOCUMENTS 5,344,034 A * 9/1994 Eagan ..... A61J 9/00 215/11.1
6,805,072 B1 * 10/2004 DeSano ..... A61J 7/04 116/308
8,459,513 B2 * 6/2013 Harrower ..... B65D 47/043 220/378
9,134,288 B1 * 9/2015 Ettinger ..... G01N 33/04
2006/0108379 A1 * 5/2006 Glynn ..... G01F 11/288 222/211
2009/0178940 A1 * 7/2009 Said ..... A61J 9/00 206/221

* cited by examiner

*Primary Examiner* — Shawn M Braden

(57) ABSTRACT

An apparatus adapted to provide a decorative figure attachment to a baby bottle to engage and entertain a bottle-feeding infant has a circular attachment to a bottom portion of the bottle and a flexible extending arm that supports an eye-catching figure displayed to the baby or moveable date and time indicia disposed about the apparatus.

14 Claims, 5 Drawing Sheets

DECORATIVE ATTACHMENT FOR A BABY BOTTLE

FIELD OF THE INVENTION

The present invention relates generally to a decorative figure attachment to engage and entertain a bottle-feeding infant.

BACKGROUND OF THE INVENTION

One (1) of the first things a parent or other caregiver finds out about a new infant is that an infant requires a lot of time and care, effort and attention. However, some essentials such as feeding seem to require the most time and effort.

This being the case, it is likely that one (1) of the tasks that many people find fatiguing is the process of feeding an infant using a baby bottle. Most infants cannot hold let alone manipulate a bottle on their own. Even older babies who are somewhat skilled in propping up a bottle will invariably and repeatedly drop the bottle without assistance. The process of picking a bottle back up, cleaning it, and returning it to the baby is aggravating and time consuming. It also interrupts other tasks and activities the parent or care provider may be performing or engaged in and is especially troublesome for those who are caring for the child on their own having no one else to assist. If the parent or care provider should ignore the need of the infant to feed, he or she is met with a crescendo of screaming and crying.

Parents or caregivers who have dealt with the woes associated with bottle feeding an infant quickly learn that entertaining children while they are feeding can often result in a calmer and attentive feeding experience for the child. A screaming and upset child will seldom enjoy taking a bottle, but a distraction such as a moving decorative feature like an animal or some other soothing visual component, may make the critical difference between a calm feeding and a stressful feeding. Therefore, a means to attach a decorative feature to a baby bottle, which additionally has a means to be motioned, is highly beneficial to child and parent or caregiver alike.

SUMMARY OF THE INVENTION

The inventors have recognized the aforementioned issues and inherent problems and observed that there is a lack in the prior art for a means to easily attach a decorative feature to a baby bottle.

It is therefore an object of the invention to provide an attachment comprising a model having a connector and a ring connected to the model via the connector. The ring comprises a flexible upper member, a flexible lower member, a ring aperture and a stop which at least partially extends into the ring aperture. The ring is adapted to be placed circumferentially about an outer base surface of a baby bottle. The model may comprise a head which may have disposed upon it an integrally molded anthropomorphized or comical facial feature. The connector comprises a flexibly resilient material.

An alternate embodiment of the attachment comprises a ring comprising a stationary inner member having a flexible upper member disposed on a first side, a flexible lower member disposed on a second side, a circumferential groove and a moveable outer member having a first side and a second side. The alternate embodiment also comprises a ring aperture and a stop which at least partially extends within the ring aperture. The moveable outer member of this embodiment slidably rests within the groove of the stationary inner member and is adapted to be placed circumferentially about an outer base surface of a baby bottle. The stationary inner member and moveable outer member both comprise a plurality of integrally molded indicia upon an exterior portion of the first side and the second side respectively. One (1) of the plurality of integrally molded indicia may comprise a primary positional indicator.

With respect to both embodiments, the flexible upper member may comprise a plurality of tabs which are disposed circumferentially about a midsection of the ring and perpendicularly to the ring aperture. The flexible upper member may also comprise a slight inward angle which projects towards the ring aperture. Likewise, the flexible lower member comprises a plurality of tabs disposed circumferentially about a midsection of the ring and perpendicularly to the ring aperture. The flexible lower member comprises further comprises a slight inward angle projecting towards the ring aperture. The ring further comprises a plurality of three dimensional moldings which may have a tether aperture which is adjacent to an outer circumference of the ring.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
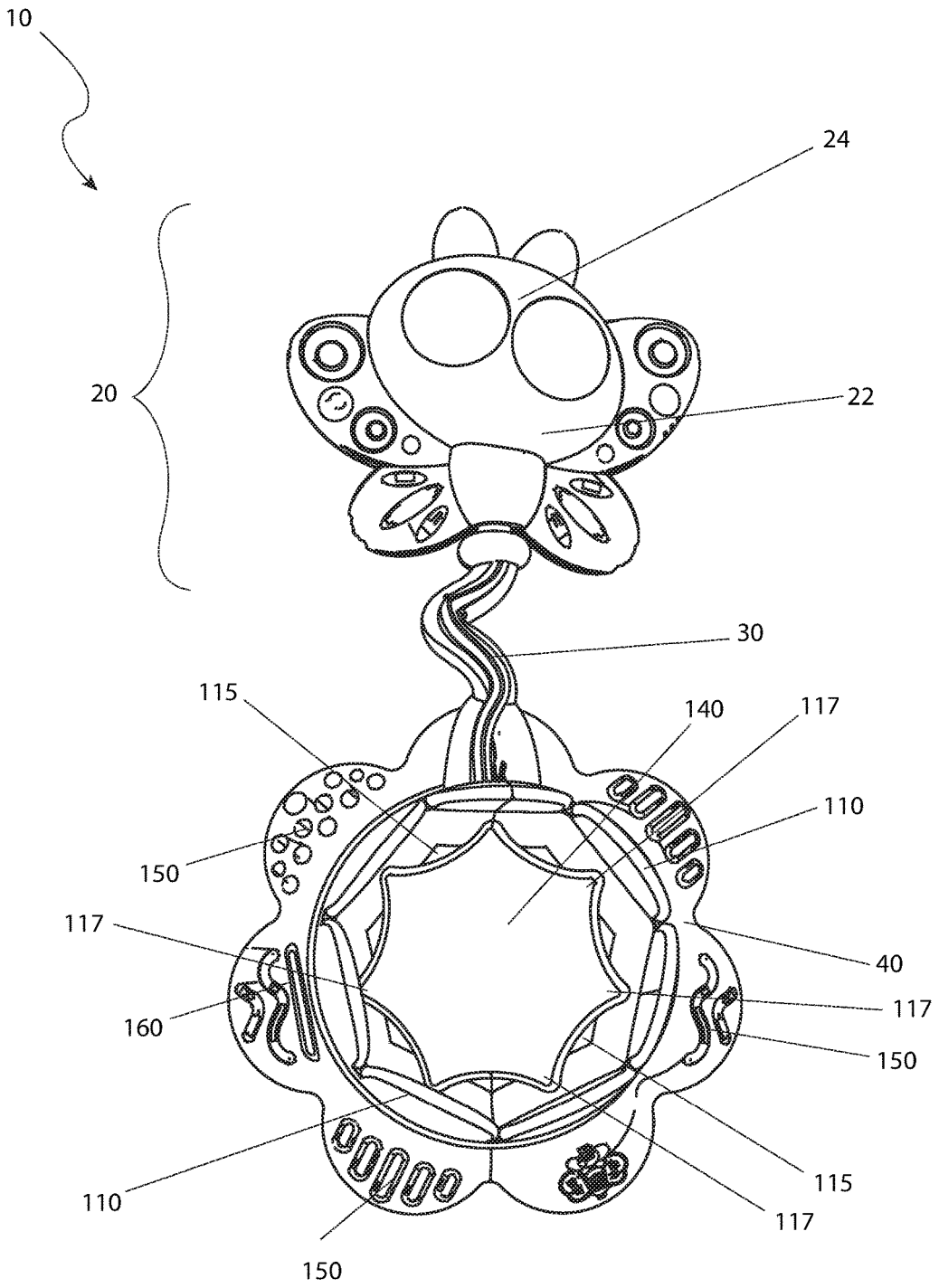
FIG. 1 is an isometric view of a decorative figure attachment 10 for baby bottles 100 in accordance with the preferred embodiment of the present invention.

10 decorative figure attachment
10*a* alternate embodiment decorative figure attachment
20 model
22 head
24 face
30 connector
40 bottle ring
42 ring aperture
100 bottle
101 stationary inner member
105 movable outer member
110 flexible upper friction members
111 flexible lower friction members
115 bottle stop
117 bottle stop vent
120 stationary indicia
125 movable indicia
130 primary movable indicia

135 groove
140 travel path "$t_1$"
145 angle "a"
150 three-dimensional molding
160 tether aperture

DETAILED DESCRIPTION OF THE PREFERRED EMBODIMENT

Figure 4:
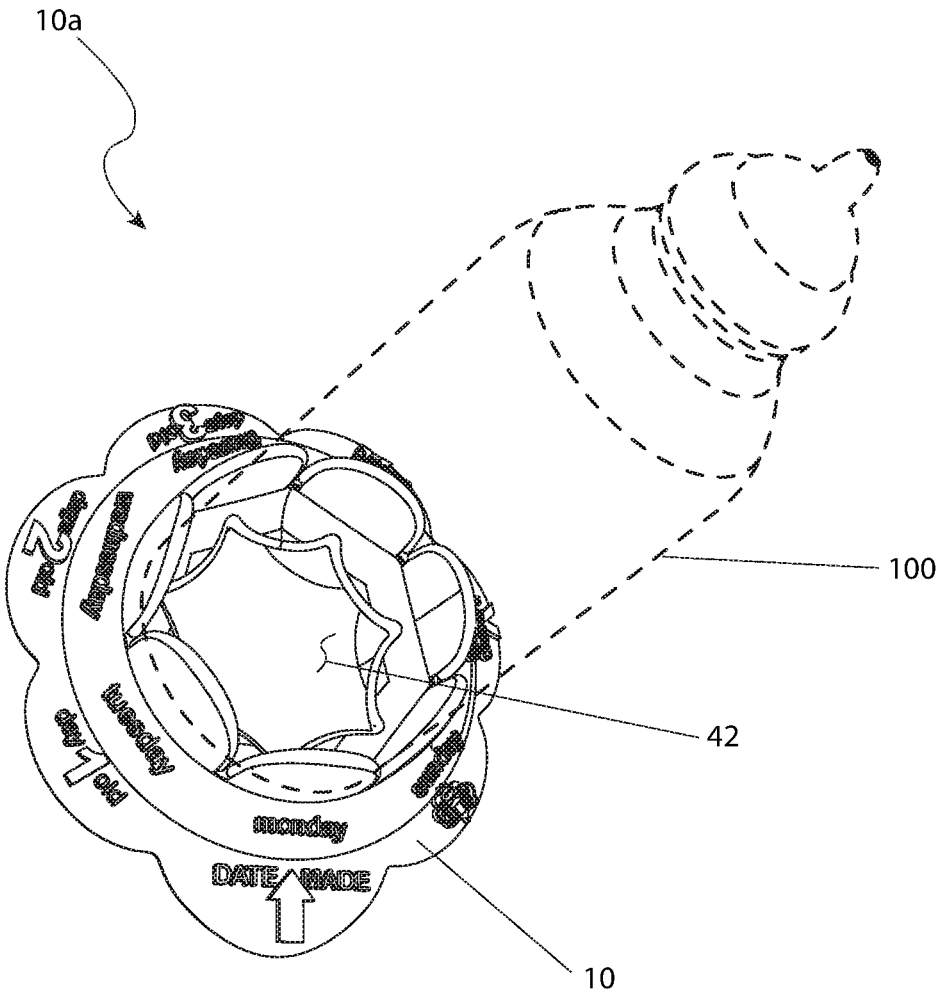
FIG. 4 is a perspective view of a decorative figure attachment 10*a* shown in an installed state upon a baby bottle 100 in accordance with the preferred embodiment of the present invention.

The best mode for carrying out the invention is presented in terms of its preferred and alternate embodiment, herein depicted within FIGS. 1 and 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a decorative figure attachment 10 for a baby bottle (herein referred to as the "apparatus") 100, which provides any decorative model 20, such as a characterization of a portion, or all, of an animal, or some other object, capable of being attached to a baby bottle 100 by means of a bottle ring 40 temporarily placed around a bottom outer diameter or girth of the bottle 100 at an optimal visual distance for the purpose of capturing, or keeping, the attention of a feeding infant so as to promote the consumption of at least an adequate portion of the supplied foodstuffs. The model 20 may be provided with a flexible connector 30 to the bottle ring 40 so as to provide more animation to accomplish the intended purpose of the apparatus 10. The flexible connector may incorporate an embedded spring not shown. The present invention in its preferred state is intended to provide visual information regarding the content, state, or other physical information on the content of the attached baby bottle 100 on a resettable basis.

Referring now to FIG. 1, an isometric view of a decorative figure attachment 10 for baby bottles 100 in accordance with the preferred embodiment of the present invention is shown. The decorative figure attachment 10 includes a model 20, a connector 30, and a bottle ring 40. The model 20 is preferably presented as the stylized head of an animal; however, it is understood that virtually any eye-catching image, such as a clown, a shiny bauble, mirror, photograph, light or encased sound making elements such as a rattle, beads, bells, squeaking devices and/or electronic sound recordings may be utilized without limiting the scope of the decorative figure attachment 10. The model 20 is preferably configured to be head 22 having an internal filling provided for structural integrity and a face 24 having an anthropomorphized, or comical, facial features such as eyes, nose, or muzzle, and a mouth appropriate to the intended subject matter. The features of the face 24 may be disposed upon the head 22 by means of the addition of other fabrics, or other materials, by stitching, such as embroidery, or by the coloration of the fabric by means of dyes, paints, inks, or the like. The model 20 may also be composed of a molded thermoplastic material with certain features painted on the head 22 and the face 24 without limiting the scope of the decorative figure attachment 10. A ring 40 temporarily placed around a bottom outer diameter or girth of the bottle 100 at an optimal visual distance for the purpose of capturing, or keeping, the attention of a feeding infant so as to promote the consumption of at least an adequate portion of the supplied foodstuffs. The model 20 may be provided with a flexible connector 30 to the bottle ring 40 so as to provide more animation to accomplish the intended purpose of the decorative figure attachment 10. As aforementioned described, the retention of the ring 40 upon the bottle 100 (not shown in this figure), is aided by both flexible upper friction members 110, flexible lower friction members 111 and a bottle stop 115 which partially extends into the bottle aperture 42 in a manner which is perpendicular to the upper and lower friction members 110, 111 and which function similarly to that of the alternate embodiment of the decorative figure attachment 10*a*. The bottle stop 115 prevents the bottle 100 from fully penetrating the bottle ring 40 thereby securing the decorative figure attachment 10, 10*a* to the base of the bottle 100. The plurality of scalloped bottle stop vents 117 disposed within the bottle stop 115 preserves the function of bottle(s) 100 that have a bottom venting feature.

Finally, various three dimensional moldings 150 are located upon the bottle ring 40 to provide relaxing tactile feedback to the infant or child utilizing the decorative figure attachment 10 so as to promote the consumption of at least an adequate portion of the supplied foodstuffs while secondarily providing a teething means and facilitate tactile exploration of the bottle. Within a given three-dimensional molding 150 is located a tether aperture 160 envisioned to permit the device 10 to be removably secured by means of a tether (not shown in this FIGURE) to an object adjacent to the device 10 such as a highchair or stroller.

Figure 2:
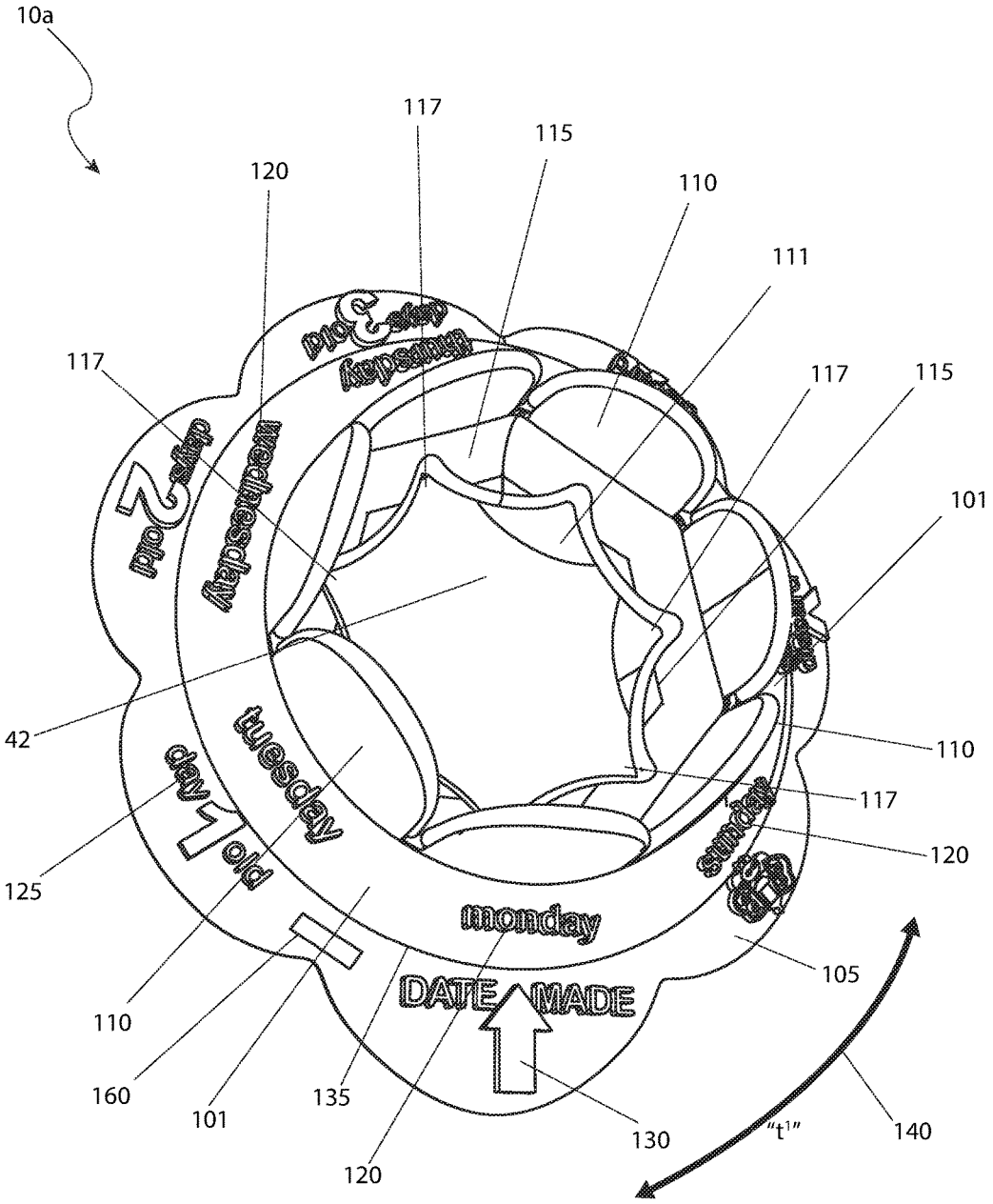
FIG. 2 is an isometric view of a decorative figure attachment 10*a* for baby bottles 100 in accordance with the alternate embodiment of the present invention.

Referring next to FIG. 2, an isometric view of a decorative figure attachment 10*a* for baby bottles 100 in accordance with the alternate embodiment of the present invention is disclosed. The decorative figure attachment 10*a* comprises primarily of a stationary inner member 101 and a movable outer member 105. The stationary inner member 101 is provided with a plurality of flexible upper friction members 110 and flexible lower friction members 111. All components of the decorative figure attachment 10*a* including the flexible upper friction members 110, the flexible lower friction members 111 and bottle stop 115 are envisioned to be of a flexible rubber-like compound such as a variation of thermoplastic elastomers (TPE), or silicone rubber. The specific type of material is not intended to limit the present invention as those familiar in the art will realize that many different materials will exhibit the characteristic described.

The flexible upper friction members 110 and the flexible lower friction members 111 will slide over a baby bottle 100 (as will be further illustrated herein below). The variable nature of the flexible upper friction members 110 and flexible lower friction members 111 will allow for the use of different manufacturer, model, styles, and sizes of baby bottles 100 thus providing a universal design. The movable outer member 105 moves relative to the stationary inner member 101. The stationary inner member 101 is provided with multiple stationary indicia 120. The depicted stationary indicia 120 indicate a quantity of seven (7) to correspond to the days of the week, although other stationary indicia 120 of different quantities could indicate alternate parameters such as time, location, usage, or the like, and as such, are not intended to be a limiting factor of the present invention. The movable outer member 105 is provided with movable indicia 125. The movable indicia 125 provides for primary movable indicator indicia 130, here depicted as an arrow, that lines up with one (1) of the movable indicia 125, depicted in FIG. 2 by "MONDAY". As such, other movable indicia 125 correspond to other stationary indicia 120 to provide useful information such as to elapsed time periods, usage histories, and the like. Movement is accomplished via a groove 135 located in the stationary inner member 101 allowing the movable outer member 105 to function as a sliding ring. Said movement is provided in a clockwise or counterclockwise rotation as indicated by a travel path "$t_1$" 140. Further description of said movement will be provided herein below.

Figure 3:
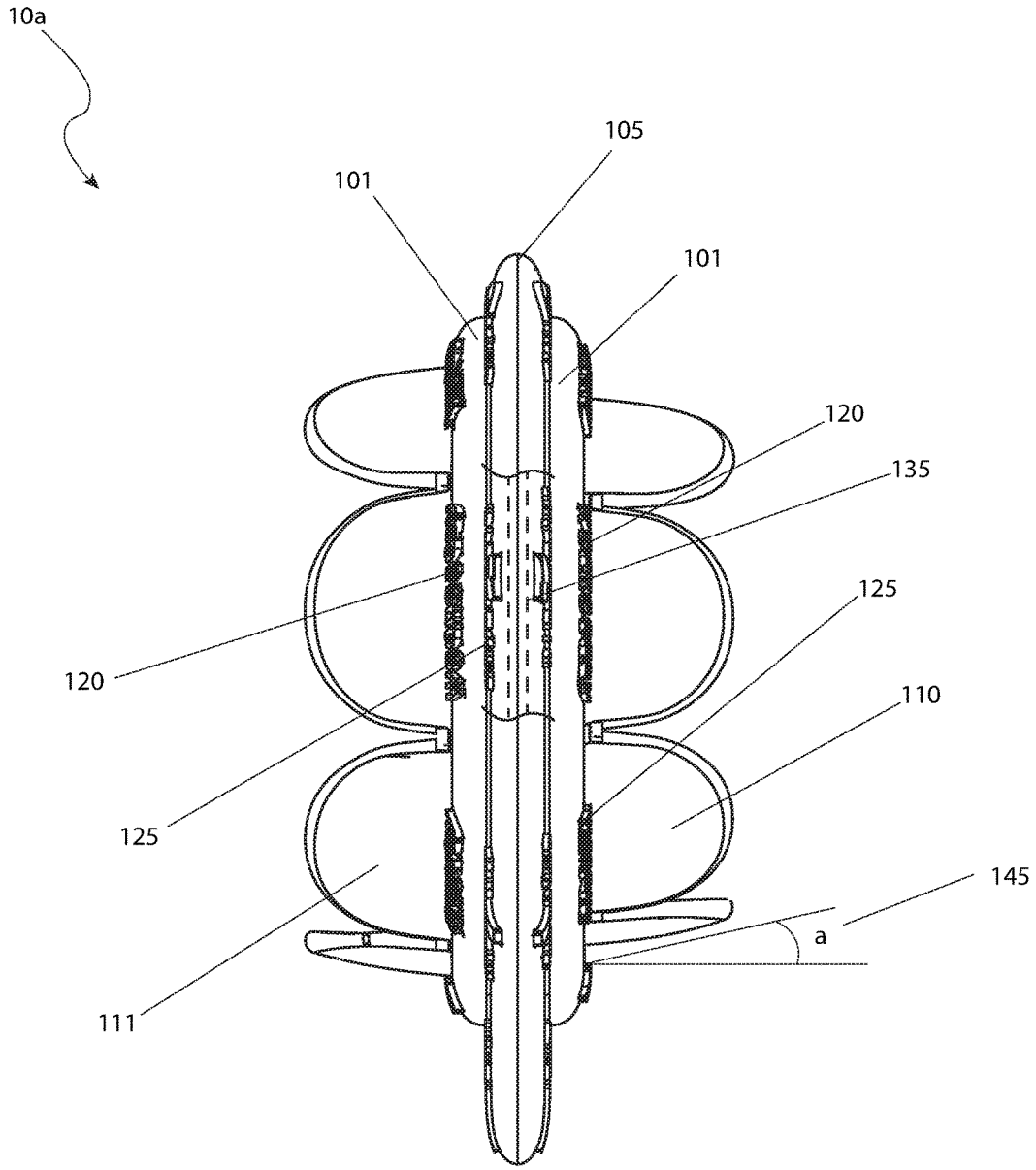
FIG. 3 is a side view of a decorative figure attachment 10*a* for baby bottles 100 in accordance with the alternate embodiment of the present invention.
Figure 5:
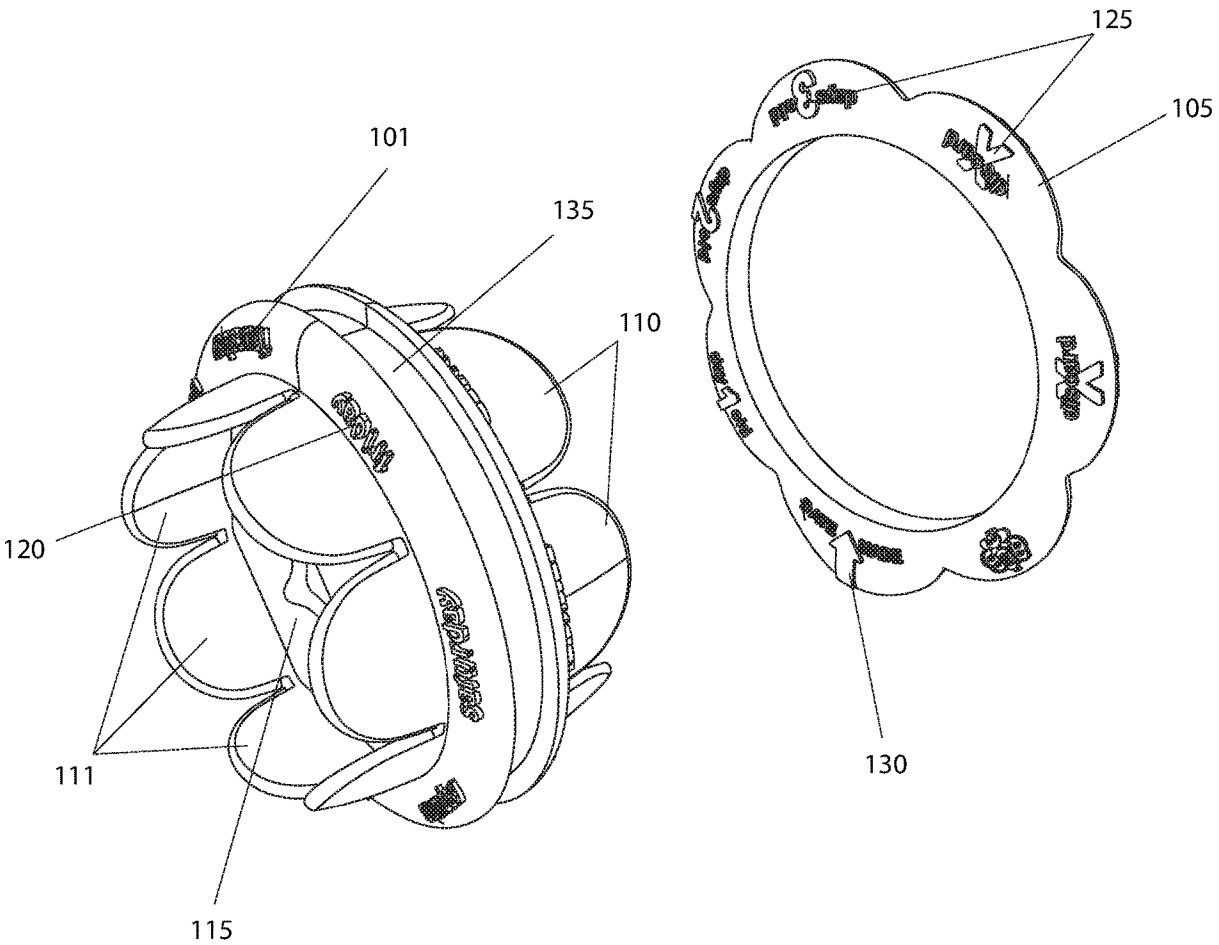
FIG. 5 is an exploded view of stationary inner member 101 and movable outer member 105 of a decorative figure attachment 10*a* for baby bottles 100 in accordance with the alternate embodiment of the present invention.

Referring next to FIG. 3, which is a side view of a decorative figure attachment 10*a* for baby bottles 100 in accordance with the alternate embodiment of the present invention is depicted and FIG. 5, which is an exploded view of stationary inner member 101 and movable outer member 105 of a decorative figure attachment 10*a* for baby bottles 100 in accordance with the alternate embodiment of the present invention. Stationary indicia 120 are provided on both the top and bottom faces of the stationary inner member 101 and are relatively corresponding (identical side to side) in nature. In a similar process, corresponding movable indicia 125 are provided on both the top and bottom faces of the movable outer member 105. Indicia depict the same information on either side of the stationary inner member 101 and the movable outer member 105. Said dual indicia provides for universal usage of the decorative figure attachment 10 in either orientation. The groove 135 (depicted by partial hidden line due to illustrative restrictions in FIG. 3 and fully detailed in an exploded view FIG. 5) is provided as an integral part of the stationary inner member 101 and provides needed friction between the stationary inner member 101 and the movable outer member 105. Said friction is envisioned to be adequate to prevent rotation of the movable outer member 105 accidentally or by an infant, however easily overcome by an adult or care provider initially preparing the baby bottles 100.

All components of the decorative figure attachment 10, 10*a* are envisioned to be manufactured in an injection molding process of brightly colored raw material. Both the flexible upper friction members 110 and the flexible lower friction members 111 comprise a plurality of tabs disposed circumferentially about a midsection of the ring and are perpendicular to the ring aperture. Additionally, both the flexible upper friction members 110 and the flexible lower friction members 111 are manufactured with a slight inward angle depicted by angle "a" 145 to aid in retention upon a bottle 100 (not shown in this FIGURE).

Referring finally, to FIG. 4, a perspective view of a decorative figure attachment 10*a* shown in an installed state upon a baby bottle 100 in accordance with the alternate embodiment of the present invention is depicted. The decorative figure attachment 10, 10*a* is provided with a centrally located ring aperture 42 of an appropriate diameter to accommodate the insertion of a lower end of a baby bottle 100 with some deformation of the decorative figure attachment 10, 10*a* required. This expansion of the bottle ring 40 upon insertion assures that the decorative figure attachment 10, 10*a* will be adequately secured to the feeding bottle 100 during use. A similar presentation is envisioned when the preferred embodiment of the decorative figure attachment 10 (as shown in FIG. 1) is utilized upon a baby bottle 100.

The preferred and alternate embodiments of the present invention can be utilized by the common user in a simple and effortless manner with little or no training. It is envisioned that the decorative figure attachment 10, 10*a* would be constructed in general accordance with FIG. 1 through FIG. 4. After purchase or acquisition of the decorative figure attachment 10, 10*a*, it would be installed as indicated in FIG. 4.

The method of installing and utilizing the apparatus 10, 10*a* may be achieved by performing the following steps: acquiring a model, either of the preferred embodiment of FIG. 1 or the alternate embodiment of FIG. 2 and FIG. 3 of the decorative figure attachment 10, 10*a* having a style to suit the taste of a user; filling the selected feeding bottle 100 with a desired nutritional formula; expanding the decorative figure attachment 10, 10*a* to accommodate the girth of the bottle 100; sliding the decorative figure attachment 10, 10*a* onto the bottle 100 to the desired location and desired orientation; and feeding the infant while holding the bottle 100 so as to maintain the decorative figure attachment 10, 10*a* in the infant's line of sight. During use of the preferred embodiment 10 of FIG. 1, should the infant's interest in the consumption of the contents of the bottle 100 wane, a slight tap on the bottle 100 or model 20 will cause the model 20 to move and refocus the infant's attention on the bottle 100.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An attachment comprising:

a model;

a connector; and, a ring connected to said model via said connector, comprising;

a flexible lower member;

a ring aperture;

a flexible upper member, comprising a plurality of tabs disposed circumferentially about a midsection of said ring and perpendicular to said ring aperture; and, a stop at least partially extending within said ring aperture;

wherein said flexible upper member further comprises a slight inward angle projecting towards said ring aperture; and, wherein said ring is adapted to be placed circumferentially about an outer base surface of a baby bottle.

2. The attachment of claim 1, wherein said model comprises a head.

3. The attachment of claim 2, wherein said head has disposed upon it an integrally molded anthropomorphized or comical facial feature.

4. The attachment of claim 1, wherein said connector comprises a flexibly resilient material.

5. The attachment of claim 1, wherein said flexible lower member comprises a plurality of tabs disposed circumferentially about a midsection of said ring and perpendicular to said ring aperture.

6. The attachment of claim 5, wherein said flexible lower member comprises further comprises a slight inward angle projecting towards said ring aperture.

7. The attachment of claim 1, wherein said ring further comprises a tether aperture adjacent an outer circumference of said ring.

8. An attachment comprising:

a ring comprising a stationary inner member having a flexible upper member disposed on a first side, a flexible lower member disposed on a second side, a circumferential groove, and a moveable outer member having a first side and a second side;

a ring aperture; and, a stop at least partially extending within said ring aperture;

wherein said flexible upper member further comprises:

a plurality of tabs disposed circumferentially about a midsection of said ring and perpendicular to said ring aperture; and, a slight inward angle projecting towards said ring aperture;

wherein said moveable outer member slidably rests within said groove of said stationary inner member; and, wherein said ring is adapted to be placed circumferentially about an outer base surface of a baby bottle.

9. The decorative attachment of claim 8, wherein said stationary inner member comprises a plurality of integrally molded indicia upon an exterior portion of said first side and said second side.

10. The attachment of claim 8, wherein said moveable outer member comprises a plurality of integrally molded indicia upon an exterior portion of said first side and said second side.

11. The attachment of claim 10, wherein one of said plurality of integrally molded indicia upon an exterior portion of said first side and said second side comprises a primary positional indicator.

12. The attachment of claim 8, wherein said flexible lower member comprises a plurality of tabs disposed circumferentially about a midsection of said ring and perpendicular to said ring aperture.

13. The attachment of claim 12, wherein said flexible lower member comprises further comprises a slight inward angle projecting towards said ring aperture.

14. The attachment of claim 8, wherein said ring further comprises a tether aperture adjacent an outer circumference of said ring.

* * * * *